US007069212B2

(12) United States Patent
Tanaka et al.

(10) Patent No.: US 7,069,212 B2
(45) Date of Patent: Jun. 27, 2006

(54) AUDIO DECODING APPARATUS AND METHOD FOR BAND EXPANSION WITH ALIASING ADJUSTMENT

(75) Inventors: Naoya Tanaka, Osaka (JP); Osamu Shimada, Tokyo (JP); Mineo Tsushima, Osaka (JP); Takeshi Norimatsu, Hyogo (JP); Kok Seng Chong, Singapore (SG); Kim Hann Kuah, Singapore (SG); Sua Hong Neo, Singapore (SG); Toshiyuki Nomura, Tokyo (JP); Yuichiro Takamizawa, Tokyo (JP); Masahiro Serizawa, Tokyo (JP)

(73) Assignees: Matsushita Elecric Industrial Co., Ltd., Osaka (JP); NEC Corporation, Tokyo (JP)

( * ) Notice: Subject to any disclaimer, the term of this patent is extended or adjusted under 35 U.S.C. 154(b) by 0 days.

(21) Appl. No.: 10/496,798

(22) PCT Filed: Sep. 11, 2003

(86) PCT No.: PCT/JP03/11601

§ 371 (c)(1),
(2), (4) Date: Feb. 22, 2005

(87) PCT Pub. No.: WO2004/027368

PCT Pub. Date: Apr. 1, 2004

(65) Prior Publication Data

US 2005/0149339 A1 Jul. 7, 2005

(30) Foreign Application Priority Data

Sep. 19, 2002 (JP) ..... 2002-273557
Sep. 27, 2002 (JP) ..... 2002-283722
Oct. 15, 2002 (JP) ..... 2002-300490

(51) Int. Cl.
*G10L 21/02* (2006.01)

(52) U.S. Cl. ..... 704/225; 704/205; 704/228; 704/268; 704/501

(58) Field of Classification Search ..... None
See application file for complete search history.

(56) References Cited

U.S. PATENT DOCUMENTS

| | | | | |
|---|---|---|---|---|
| 4,691,292 | A * | 9/1987 | Rothweiler | 708/316 |
| 4,766,562 | A * | 8/1988 | Vary | 708/313 |
| 5,301,255 | A * | 4/1994 | Nagai et al. | 704/230 |
| 5,327,366 | A * | 7/1994 | Mau | 708/321 |
| 5,508,949 | A | 4/1996 | Konstantinides | |
| 5,654,952 | A * | 8/1997 | Suzuki et al. | 369/59.16 |
| 5,978,759 | A | 11/1999 | Tsushima et al. | |
| 6,539,355 | B1 * | 3/2003 | Omori et al. | 704/268 |
| 6,680,972 | B1 | 1/2004 | Liljeryd et al. | |
| 6,681,209 | B1 | 1/2004 | Schmidt et al. | |
| 6,718,300 | B1 | 4/2004 | Schuller | |
| 6,895,375 | B1 * | 5/2005 | Malah et al. | 704/219 |
| 2004/0078194 | A1 | 4/2004 | Liljeryd et al. | |
| 2004/0078205 | A1 | 4/2004 | Liljeryd et al. | |
| 2004/0125878 | A1 | 7/2004 | Liljeryd et al. | |

FOREIGN PATENT DOCUMENTS

| | | |
|---|---|---|
| EP | 0 488 504 | 6/1992 |
| EP | 0 661 827 | 7/1995 |
| EP | 0 957 579 | 11/1999 |
| EP | 0 957 580 | 11/1999 |
| EP | 1 160 977 | 12/2001 |
| EP | 1 367 566 | 12/2003 |
| JP | 7-210196 | 8/1995 |
| JP | 8-162964 | 6/1996 |
| JP | 9-101798 | 4/1997 |
| JP | 11-109994 | 4/1999 |
| JP | 2000-68948 | 3/2000 |
| JP | 2001-521648 | 11/2001 |
| JP | 2002-55698 | 2/2002 |
| WO | 98/57436 | 12/1998 |
| WO | 00/45379 | 8/2000 |
| WO | 02/41301 | 5/2002 |

OTHER PUBLICATIONS

Y. Nakatoh et al.: "Generation of Broadband Speech from Narrowband Speech Using Piecewise Linear Mapping", 5th European Conference on Speech Communication and Technology. Eurospeech '97. Rhodes, Greece, Sep. 22-25, 1997, European Conference on Speech Communication and Technology. (Eurospeech), Grenoble: ESCA, FR, vol. 3 of 5, Sep. 22, 1997, pp. 1643-1646, XP001045142, abstract; figures 1,2, paragraph '0002.

* cited by examiner

*Primary Examiner*—Donald L. Storm
(74) *Attorney, Agent, or Firm*—Wenderoth, Lind & Ponack, L.L.P.

(57) ABSTRACT

An audio decoding apparatus decodes high frequency component signals using a band expander that generates multiple high frequency subband signals from low frequency subband signals divided into multiple subbands and transmitted high frequency encoded information. The apparatus is provided with an aliasing detector and an aliasing remover. The aliasing detector detects the degree of occurrence of aliasing components in the multiple high frequency subband signals generated by the band expander. The aliasing remover suppresses aliasing components in the high frequency subband signals by adjusting the gain used to generate the high frequency subband signals. Thus occurrence of aliasing can be suppressed and the resulting degradation in sound quality can be reduced, even when real-valued subband signals are used in order to reduce the number of operations.

30 Claims, 8 Drawing Sheets

AUDIO DECODING APPARATUS AND METHOD FOR BAND EXPANSION WITH ALIASING ADJUSTMENT

TECHNICAL FIELD

The present invention relates to a decoding apparatus and decoding method for an audio bandwidth expansion system for generating a wideband audio signal from a narrowband audio signal by using a small amount of additional information, and relates to technology enabling decoding a high audio quality signal with few calculations.

BACKGROUND ART

Bandwidth division encoding is a common method of encoding an audio signal at a low bit rate while still achieving a high quality playback signal. This is done by splitting an input audio signal into signals for plural frequency bands (subbands) using a band division filter, or by converting the input signal to a frequency domain signal using a Fourier transform or other time-frequency conversion algorithm, then dividing the signal into multiple subbands in the frequency domain, and allocating an appropriate coding bit to each of the bandwidth divisions. The reason why a high quality playback signal can be obtained from low bit rate data using bandwidth division encoding is that during the encoding process the signal is processed based on human acoustic sense characteristics.

Human auditory sensitivity at a frequency of approximately 10 kHz or greater generally drops, and low sound levels become difficult to hear. Furthermore, a phenomenon called "frequency masking" is well known. Due to frequency masking, when there is a high level sound in a particular frequency band, low level sounds in neighboring frequency bands become difficult to be audible. Allocating bits and encoding signals that are difficult to be sensed due to such auditory characteristics has substantially no effect on the quality of the playback signal, and therefore encoding such signals is meaningless. Conversely, by taking the code bits allocated to this audibly meaningless band and reallocating the bits to audibly sensitive subbands, audibly sensitive signals can be encoded with great detail, thereby effectively improving the quality of the playback signal.

An example of such coding using band division is MPEG-4 MC (ISO/IEC 14496-3) by international standard, which enables high quality coding of a 16 kHz or greater wideband stereo signal at an approximately 96 Kbps bit rate.

If the bit rate is lowered to, for example, approximately 48 Kbps, only a 10 kHz or shorter bandwidth can be encoded with high quality, resulting in muffled sound. One method of compensating for degraded sound quality resulting from such bandwidth limiting is called SBR (spectral band replication) and is described in the Digital Radio Mondiale (DRM) System Specification (ETSI TS 101 980) published by the European Telecommunication Standards Institute (ETSI). Similar technology is also disclosed, for example, in AES (Audio Engineering Society) convention papers 5553, 5559, 5560 (112th Convention, 2002 May 10–13, Munich, Germany).

SBR seeks to compensate for the high frequency band signals (referred to as high frequency components) that are lost by the audio encoding process such as MC or equivalent band limiting process. Signals in frequency bands below the SBR-compensated band (also called low frequency components) must be transmitted by some other means. Information for generating a pseudo-high frequency component based on the low frequency components transmitted by other means is contained in the SBR-coded data, and audio degradation due to band limiting can be compensated for by adding this pseudo-high frequency component to the low frequency components.

FIG. 7 is a schematic diagram of a decoder for SBR band expansion according to the prior art. Input bitstream 106 is separated into low frequency component information 107, high frequency component information 108, and added information 109. The low frequency component information 107 is, for example, information encoded using the MPEG-4 AAC or other coding method, and is decoded to generate a time signal representing the low frequency component. This time signal representing the low frequency component is divided into multiple subbands by analysis filter bank 103.

The analysis filter bank 103 is generally a filter bank that uses complex-valued coefficients, and the divided subband signal is represented as a complex-valued signal. Band expander 104 compensates for the high frequency component lost due to bandwidth limiting by copying low frequency subband signals representing low frequency components to high frequency subbands. The high frequency component information 108 input to the band expander 104 contains gain information for the compensated high frequency subband so that gain is adjusted for each generated high frequency subband.

The high frequency subband signal generated by the band expander 104 is then input with the low frequency subband signal to the synthesis filter bank 105 for band synthesis, and output signal 110 is generated. Because the subband signals input to the synthesis filter bank 105 are generally complex-valued signals, a complex-valued coefficient filter bank is used as the synthesis filter bank 105.

SUMMARY OF THE INVENTION

The decoder configured as above for band expansion requires may operations in a decoding process, since two filter banks including the analysis filter bank and synthesis filter bank perform complex-valued calculations. Accordingly, when the decoder is implemented using integrated circuits, there is a problem that power consumption increases and the playback time that is possible with a given power supply capacity decreases.

The decoded signals that are actually output from the synthesis filter bank are real-valued signals, and thus the synthesis filter bank may be configured with real-valued filter banks in order to reduce the number of operations performed for decoding. However, because the characteristics of a synthesis filter bank (a real-valued coefficient synthesis filter bank) that performs only real-valued operations differ from those of a synthesis filter bank (a complex-valued coefficient synthesis filter bank) that performs complex-valued operations as in the prior art, the complex-valued synthesis filter bank cannot be simply replaced by a real-valued synthesis filter bank.

FIG. 8A to FIG. 8E show the characteristics of a complex-valued coefficient filter bank and a real-valued coefficient filter bank. A tone signal for any given frequency has a single line spectrum as shown in FIG. 8A. When an input signal containing this tone signal 201 is split into multiple subbands by the analysis filter bank, the line spectrum denoting tone signal 201 is contained in a single particular subband signal. Ideally, signals contained in subband m, for example, denote only signals in the frequency band from $m\pi/M$ to $(m+1)\pi/M$.

With an actual analysis filter bank, however, signals from adjacent subbands to a given subband are contained in the given subband according to the frequency characteristic of the band division filter. FIG. 8B shows an example of a complex-valued coefficient filter bank used as the analysis filter bank. In this case the tone signal 201 appears as a complex-valued signal, and is contained in subband m signal 203 as shown by the solid line in the figure, and in subband m−1 signal 204 as shown by the dotted line. Note that the tone signal contained in both subbands occupies the same location on the frequency axis. The high frequency subband signal generating process copies both subband signals to a high frequency subband and adjusts the gain of each subband, but if the gain differs for each subband, the tone signal 201 will also have a different amplitude in each subband.

This change in tone signal amplitude remains as signal error after synthesis filtering, but because the tone signals occupy the same location on the frequency axis in both subband signals, the effect of this signal error appears only as an amplitude change in the tone signal 201 with the conventional method using a complex-valued coefficient filter bank as the synthesis filter. This error therefore has little effect on output signal quality.

When a real-valued coefficient filter bank is used as the synthesis filter, however, the complex-valued subband signal output by the complex-valued coefficient analysis filter bank must first be converted to a real-value subband signal. This can be done, for example, by rotating the real-value axis and imaginary value axis of the complex-valued subband signal ($\pi/4$), an operation that is the same deriving a DCT from a DFT. The shape of signals contained in the subband changes with this conversion process to a real-value subband signal.

FIG. 8C shows change in the (m−1) subband signal indicated by the dotted line. The spectrum of signals contained in subband (m−1) is symmetrical to the axis of the subband boundary 202 as a result of the conversion to a real-value subband signal. A signal known as an "image component" of the tone signal 201 contained in the original complex-valued subband signal therefore appears at a position symmetrical to the subband boundary 202. A similar image component 205 also appears for signals in subband m, and insofar as there is no change in the gain of subband (m−1) and subband m, these image components cancel each other out in the synthesis filtering process and do not appear in the output signal.

As shown in FIG. 8D, however, when there is a gain difference 206 in each subband in the high frequency subband signal generating process, image component 205 is not completely cancelled and appears as an error signal, called aliasing, in the output signal. As shown in FIG. 8E, this aliasing component 207 appears where a signal normally should not be (i.e., at a symmetrical position to the original tone signal across the subband boundary 202), and thus has a great effect on the sound quality of the output signal. Particularly, when the tone signal is near the subband boundary where attenuation by the band division filter is insufficient, the amplitude of the generated aliasing component increases, thus causing a significant degradation in the sound quality of the output signal.

(Means for Solving Problems)

The present invention is therefore directed to solving these problems of the prior art, and provides technology for reducing the number of operations performed in the decoding process by using a real-valued coefficient synthesis filter bank, suppressing aliasing, and improving the sound quality of the output signal.

An audio decoding apparatus according to the invention is an apparatus for decoding a wideband audio signal from a bitstream containing encoded information for a narrowband audio signal.

In a first aspect of the invention, the apparatus includes: a bitstream demultiplexer that demultiplexes encoded information from the bitstream; a decoder that decodes a narrowband audio signal from the demultiplexed encoded information; an analysis filter bank that divides the decoded narrowband audio signal into multiple first subband signals; a band expander that generates multiple second subband signals from at least one first subband signal, each second subband signal having a higher frequency band than the frequency band of the first subband signals; an aliasing remover that adjusts a gain of the second subband signal in order to suppress the aliasing components occurring in the second subband signals; and a real-valued calculation synthesis filter bank that synthesizes the first subband signal and second subband signal to obtain a wideband audio signal.

In a second aspect of the invention, the apparatus includes: a bitstream demultiplexer that demultiplexes encoded information from the bitstream; a decoder that decodes a narrowband audio signal from the demultiplexed encoded information; an analysis filter bank that divides the decoded narrowband audio signal into multiple first subband signals; a band expander that generates multiple second subband signals from at least one first subband signal, each second subband signal having a higher frequency band than the frequency band of the first subband signals; an aliasing detector that detects a degree of occurrence of aliasing components in the multiple second subband signals generated by the band expander; an aliasing remover that adjusts a gain of the second subband signal based on the detected level of aliasing components to suppress the aliasing components; and a real-valued calculation synthesis filter bank that synthesizes the first subband signal and second subband signal to obtain a wideband audio signal.

(Advantages of Invention to Prior Art)

Thus comprised, our invention suppresses aliasing in the real-value subband signal due to different gain being applied to each high frequency subband in the process generating high frequency subband signals from low frequency subband signals, and thus suppresses audio degradation due to aliasing.

DETAILED DESCRIPTION OF THE INVENTION

Preferred embodiments of an audio decoding apparatus and audio decoding method according to the present invention are described below with reference to the accompanying figures.

EMBODIMENT 1

Figure 1:
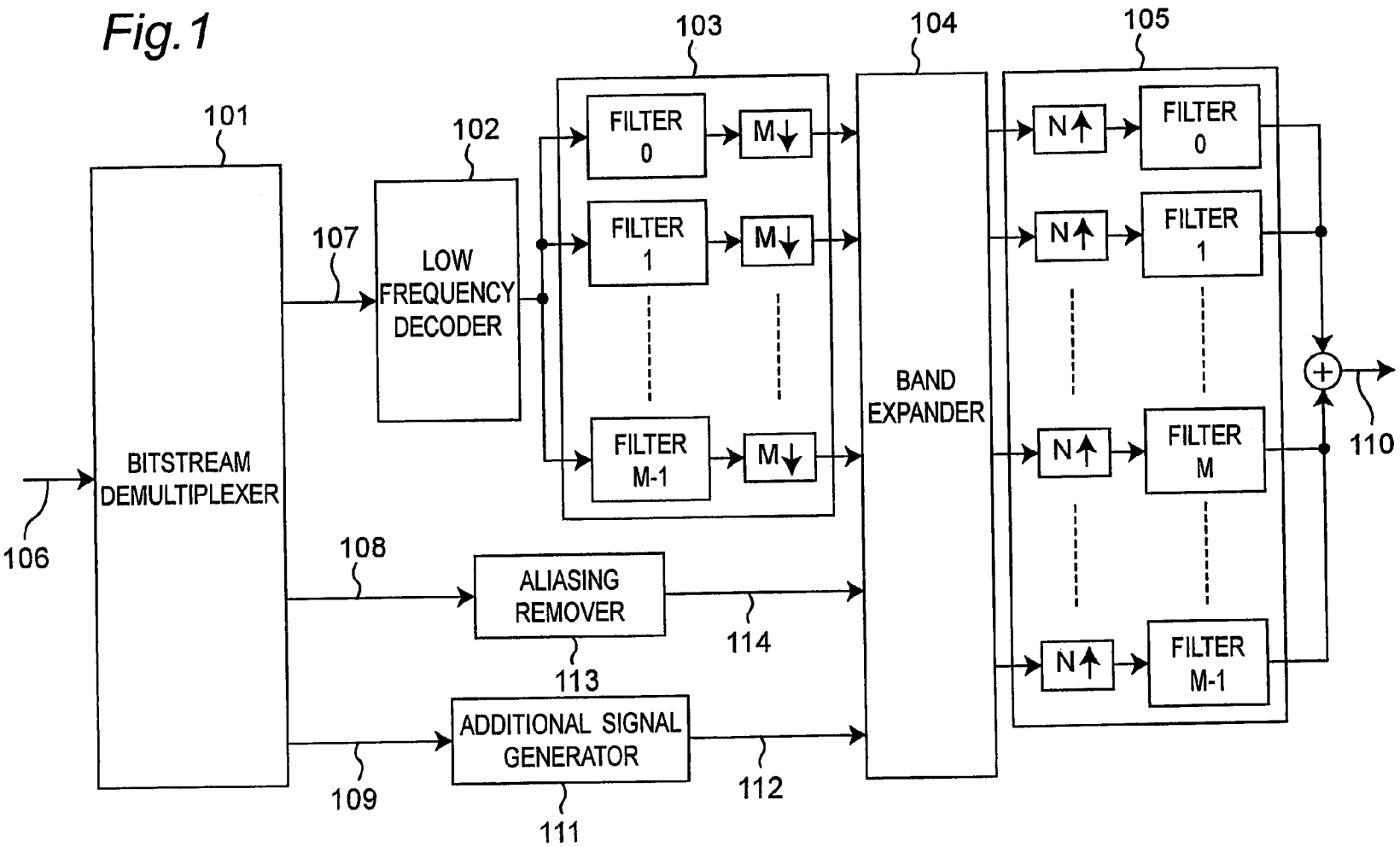
FIG. 1 is a schematic block diagram showing one example of an audio decoding apparatus according to the present invention (a first embodiment)

FIG. 1 is a schematic block diagram showing a decoding apparatus according to a first embodiment of the present invention.

This decoding apparatus has a bitstream demultiplexer 101, low frequency decoder 102, analysis filter bank 103, band expander (band expanding means) 104, synthesis filter bank 105, aliasing remover 113, and additional signal generator 111.

The bitstream demultiplexer 101 receives an input bitstream 106 and demultiplexes the bitstream 106 into low frequency component information 107, high frequency component information 108, and additional signal information 109. The low frequency component information 107 has been encoded using the MPEG-4 AAC coding method, for example. The low frequency decoder 102 decodes low frequency component information 107 and generates a time signal representing the low frequency component.

The resulting time signal representing the low frequency component is then divided into multiple (M) subbands by the analysis filter bank 103, and input to the band expander 104. The analysis filter bank 103 is a complex-valued coefficient filter bank, and the subband signals produced by the analysis filter bank 103 are represented by complex-valued signals.

The band expander 104 copies the low frequency subband signal representing the low frequency component to a high frequency subband to compensate for the high frequency components lost by bandwidth limiting. The high frequency component information 108 input to the band expander 104 contains gain information for the high frequency subband to be compensated, and the gain is adjusted for each generated high frequency subband.

The additional signal generator 111 generates a gain-controlled additional signal 112 according to the added information 109 and adds it to each high frequency subband signal. A sine tone signal or noise signal is used as the additional signal generated by the additional signal generator 111.

The high frequency subband signal generated by band expander 104 is input with the low frequency subband signal to the synthesis filter bank 105 for band synthesis, resulting in output signal 110. This synthesis filter bank 105 is a real-valued coefficient filter bank. The number of subbands used on the synthesis filter bank 105 does not need to match the number of subbands in the analysis filter bank 103. For example, if in FIG. 1 N=2M, the sampling frequency of the output signal will be twice the sampling frequency of the time signal input to the analysis filter bank.

Because only information relating to gain control is contained in the high frequency component information 108 or additional signal information 109, an extremely low bit rate can be used compared with the low frequency component information 107 containing spectrum information. This configuration is therefore suited to coding a wideband signal at a low bit rate.

The decoding apparatus shown in FIG. 1 also has an aliasing remover 113. The aliasing remover 113 inputs the high frequency component information 108 and adjusts the gain information in the high frequency component data to suppress aliasing by the real-valued coefficient synthesis filter bank 105. The band expander 104 uses the adjusted gain to generate the high frequency subband signals.

The subband signals input to the synthesis filter bank 105 in this embodiment must be real-valued signals, but conversion from a complex-valued signal to a real-valued signal can be done easily by a phase rotation operation using a method generally known in the art.

Operation of the aliasing remover 113 is described in detail below.

As described above, when a real-valued coefficient filter bank is used as the synthesis filter bank, one cause of aliasing is that adjacent subband signals are adjusted with different gain levels in the high frequency signal generation process. If the same gain is used for all adjacent subband signals, the aliasing component can be completely removed. In this case, however, the gain information transmitted as the high frequency component is not reflected, high frequency component gain does not match, and output signal quality degrades. The aliasing remover 113 must therefore reference the gain information transmitted as the high frequency component information to adjust the gain so that the aliasing components are reduced to an inaudible level, thereby preventing audio degradation caused by aliasing components and audio degradation caused by mismatched gain in the high frequency components.

Based on the fact that aliasing components increase as the gain difference between adjacent subbands increases, the aliasing remover 113 in this embodiment of the present invention sets a limit to the gain difference between adjacent subbands to reduce the effect of the resulting aliasing component.

For example, the aliasing remover 113 adjusts g[m] for all m to satisfy the following relations $$g[m] \leqq a*g[m-1]$$

$$g[m] \leqq a*g[m+1]$$

where g[m−1], g[m], and g[m+1] are the gain for three consecutive subbands m−1, m, m+1, and "a" determines the upper limit for the gain ratio between adjacent subbands and is approximately 2.0. The value of coefficient "a" can be the same for all subbands m, or a different "a" can be used for different subbands m. For example, a relatively low "a" can be applied to low frequency subbands where the audible effect of aliasing is great, and a relatively high "a" can be applied to high frequency subbands where the effects of aliasing are relatively weak.

This gain adjustment suppresses the effect of the aliasing component and thus improves audible sound quality because it limits the gain difference between adjacent subbands. Furthermore, the gain distribution of high frequency component subband signals will differ from the gain distribution based on the transmitted gain information, but the affected subbands are only those subbands where the gain ratio to the adjacent subband is significantly high. Furthermore, because the same subband gain relationship is also maintained in the adjusted gain levels, sound quality degradation due to a gain mismatch in the high frequency subband signals can be suppressed.

In addition to limiting the gain ratio between adjacent subbands, gain adjustment could adjust the gain using the average gain of multiple subbands. Using the average gain of three subbands is described next by way of example. In this case gain g'[m] for subband m after gain adjustment can be obtained to satisfy the following relation $$g'[m]=(g[m-1]+g[m]+g[m+1])/3$$

where g[m−1], g[m], and g[m+1] are the gain for three consecutive subbands m−1, m, m+1 received as the high frequency components.

Furthermore, because adjusted gain g'[m−1] for subband m−1 can be used to sequentially adjust the gain level starting from the low frequency subband, gain g'[m] can be obtained from the following equation.

$$g'[m]=(g'[m-1]+g[m]+g[m+1])/3$$

Because gain variations between subbands can be smoothed and the gain difference between adjacent subbands can be reduced by adjusting the gain as described above, aliasing components can be suppressed and audible sound quality can be improved. Furthermore, this smoothing process makes the gain distribution of high frequency subband signals different from the gain distribution based on the transmitted gain information, but the shape of the gain distribution before smoothing is retained after smoothing, and audio degradation due to gain mismatch in the high frequency subband signals can also be suppressed.

It should be noted that a simple average of the gain of multiple subbands is used in the gain smoothing process described above, but a weighted average whereby a predetermined weight coefficient is first applied to each gain level before calculating the average could be used.

To prevent the gain level from becoming too high as a result of the smoothing process even though the original gain level was very low, it is also possible when the original gain level is less than a predetermined threshold value to not apply smoothing and use the original, unadjusted, gain setting.

EMBODIMENT 2

Figure 2:
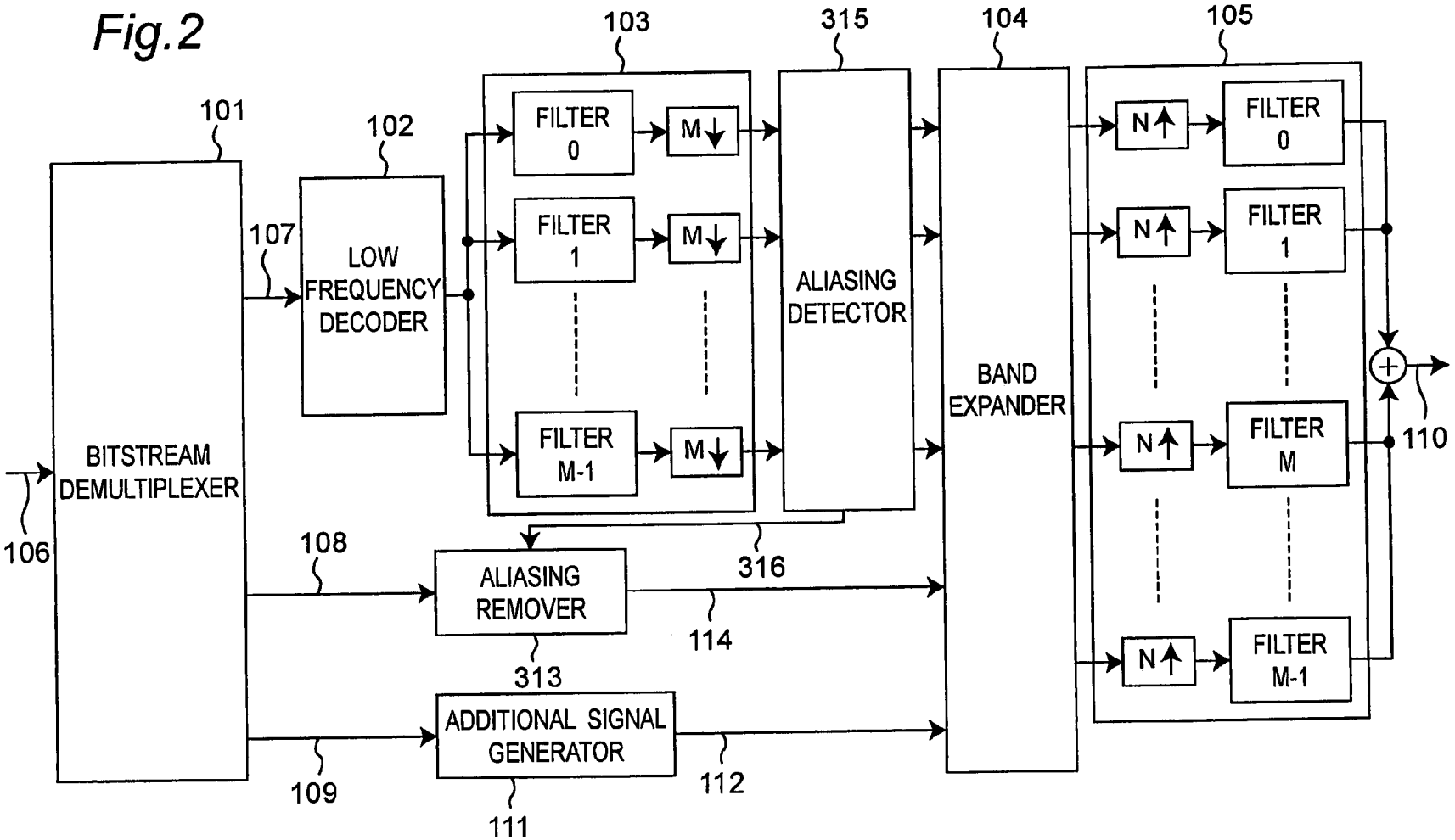
FIG. 2 is a schematic block diagram showing one example of an audio decoding apparatus according to the present invention (a second embodiment)

FIG. 2 is a schematic drawing of a decoding apparatus according to a second embodiment of the present invention. This embodiment differs from the configuration shown in FIG. 1 in the addition of an aliasing detection means (aliasing detector) 315 for detecting subbands where there is a high likelihood of aliasing components being introduced. The detection data 316 output from the aliasing detector 315 is input to aliasing remover 313 which then adjusts the gain of the high frequency components based on the detection data 316.

Operation of the decoding apparatus according to this second embodiment is the same as that of the first embodiment except for that relating to the aliasing detector 315 and aliasing remover 313. Only the operation of the aliasing detector 315 and aliasing remover 313 is therefore described below.

The operating principle of the aliasing detector 315 is described first.

Aliasing cannot logically be avoided insofar as real-valued subband signals are used, but amount of audio degradation caused by aliasing differs greatly according to the feature of the signals contained in the subband signal. As described with reference to FIG. 8, aliasing components appear at a different location than the original signal, but if the original signals in the same area were strong, the effect of the aliasing components is masked and the aliasing components have less practical effect on sound quality. Conversely, if the aliasing components appear where a signal was not originally present, only the aliasing components will be audible and their effect on sound quality is great. It is therefore possible to know how much the effect of aliasing components is by detecting signal strength around where aliasing components appear.

However, the frequency distribution of the subband signals must be determined using a Fourier transform or other frequency conversion process, for example, in order to detect the location of the aliasing components to be generated and the strength of the original surrounding signals. The problem is that this operation is not practical due to the computations required. Our invention therefore uses a method of detecting the effect of aliasing with few computations by using a parameter denoting the slope of frequency distribution of the subband signal. A premise of this method is that the effect of signals (noisy signals) with a wide frequency distribution in a given subband will be ignored, because even if aliasing occurs the effect is small due to the masking phenomenon described above.

The relationship between the position of a tone signal and any resulting aliasing components is as described above with reference to FIG. 8 for signals (tone signals) with a limited frequency distribution, and the effect of aliasing when the tone signal is near the subband boundary is great.

Figure 3:
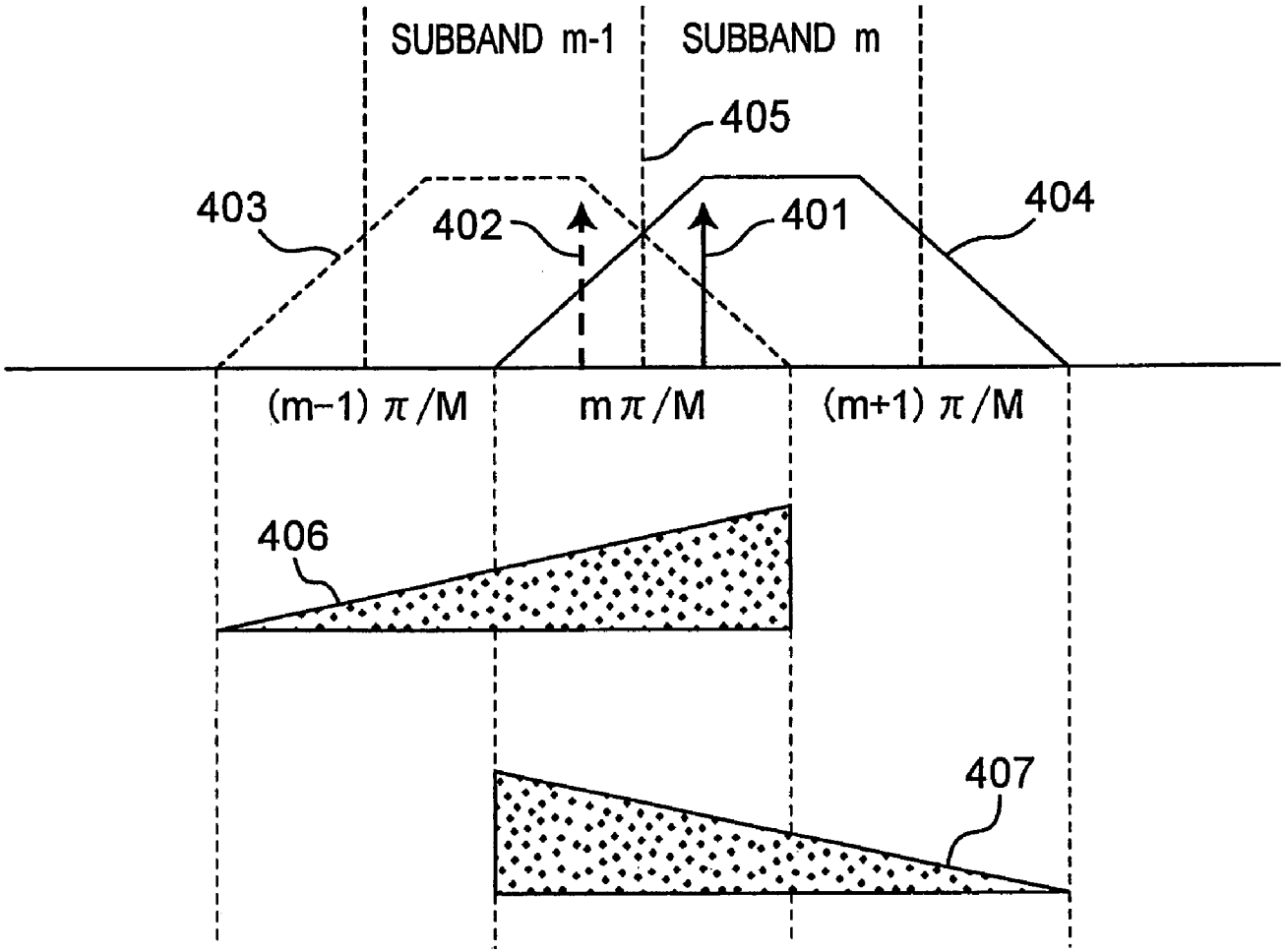
FIG. 3 describes one example of a method for detecting aliasing in an audio decoding apparatus according to the present invention.

FIG. 3 shows the relationship between tone signal position and the slope of the frequency distribution of the subband containing the tone signal. In FIG. 3 tone signal 401 and its image 402 are contained in subband m−1 signal 403 and subband m signal 404, and tone signal 401 and image 402 are located symmetrically to the subband boundary 405.

When tone signal 401 is near subband boundary 405, both tone signal 401 and its image 402 are on the high frequency side of subband m−1. The slope of frequency distribution 406 of subband m−1 is therefore positive. If the tone signal 401 is offset to the high frequency side from subband boundary 405, its image 402 moves in the opposite direction (i.e., in the low frequency direction), the slope of the frequency distribution of subband m−1 becomes more gradual and eventually goes negative. The slope of the frequency distribution 407 of subband m likewise changes from negative to positive. This means that if the slope of the frequency distribution for subband m−1 is positive and the slope of the frequency distribution for subband m is negative, a tone signal and its symmetrical image are both likely present near subband boundary 405.

A linear prediction coefficient (LPC) and a reflection coefficient can be used as parameters that can be easily calculated and denote the slope of the subband signal frequency distribution. The first-order reflection coefficient obtained by the following equation is used as this parameter by way of example.

$$k1[m] = \frac{-\sum_i \{x(m,i)\cdot x^*(m,i-1)\}}{\sum_i \{x(m,i)\cdot x^*(m,i)\}}$$

where x(m,i) denotes the signal of subband m and i denotes the time sample, and x*(m,i) denotes the complex conjugate of x(m,i) and k1[m] denotes the first-order reflection coefficient of subband m.

Because the primary reflection coefficient is positive when the slope of the frequency distribution is positive and is negative when the slope is negative, the likelihood of aliasing occurring at the boundary between subbands m−1 and m can be determined to be high if k1[m−1] is positive and k[m] is negative.

However, if a common QMF (quadrature mirror filter) is used as the subband division filter, the frequency distribution inverts between even subbands and odd subbands due to the characteristics of the filter. Considering this, conditions for detecting aliasing can be set as follows.

When $m$ is even: $k1[m-1]<0$, and $k1[m]<0$

When $m$ is odd: $k1[m-1]>0$, and $k1[m]>0$

This condition is referred to below as "detection condition 1". Detection condition 1 defines the conditions used to detect if there is any aliasing between two adjacent subbands. When detection condition 1 is applied, aliasing will not be detected twice for two consecutive subbands m and m+1, because the conditions cannot be satisfied simultaneously for even m and odd m.

The passband of a QMF generally spreads to three subbands, that is, the desired subband and the subbands on either side. In this case, if there is a tone signal near the center of the desired subband, or there is a tone signal in both the high and low frequency ranges of the desired subband, an image component will appear in the subbands on either side of the desired subband.

Figure 4A:
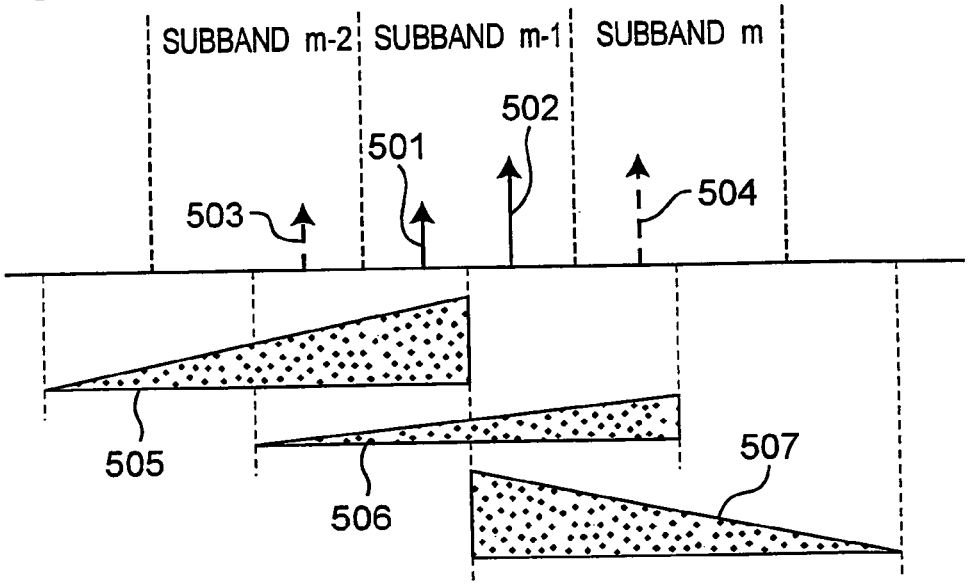
FIG. 4A and FIG. 4B describe a method for detecting aliasing in an audio decoding apparatus according to the present invention.
Figure 4B:
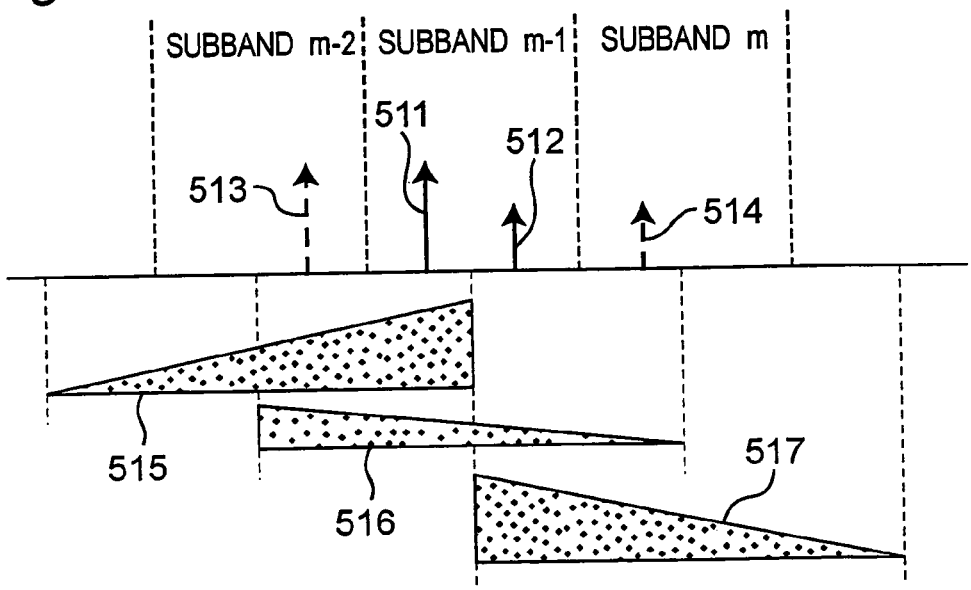

FIG. 4A and FIG. 4B show the frequency distribution when there is a tone signal in the low and high frequency ranges of a given subband. In FIG. 4A there are tone signals 501 and 502 in both the low and high frequency ranges of subband m−1, and there are tone signals 511 and 512 in FIG. 4B. Image components of tone signals 501 and 511 in the low frequency range of subband m−1 appear as signals 503 and 513, respectively, in subband m−2. Image components of tone signals 502, 512 in the high frequency range of subband m−1 appear as signals 504 and 514, respectively, in subband m.

As shown by frequency distribution 506 in FIG. 4A and frequency distribution 516 in FIG. 4B, the slope of the frequency distribution of subband m−1 is determined by the energy ratio of the low and high frequency tone signals. It is therefore not possible to detect aliasing across three subbands using detection condition 1, which is applied to detect aliasing between two subbands using the sign of the reflection coefficient of subband m−1. On the other hand, in subband m−2 and subband m, the sign of the slope of the frequency distribution is determined stable by the image components, as shown by frequency distributions 505 and 507 in FIG. 4A and frequency distributions 515 and 517 in FIG. 4B, regardless of the energy ratio between the low and high frequency tone signals in subband m−1.

This can be applied to set conditions for detecting aliasing across three subbands using the reflection coefficients of subband m−2 and subband m.

When $m$ is even: $k1[m-2]>0$ and $k1[m]<0$

When $m$ is odd: $k1[m-2]<0$ and $k1[m]>0$

These are referred to below as "detection condition 2".

However, aliasing across three subbands becomes a problem when the slope of the frequency distribution in subband m−2 and subband m is high, and detection errors increase when only detection condition 2 is applied. The slope of the frequency distribution in subbands m−2 and m changes depending upon the energy ratio between the tone signals in the low and high frequency ranges of subband m−1.

That is, if the energy of the tone signal in the low frequency range of subband m−1 is low compared with the energy of the tone signal in the high frequency range (the case shown in FIG. 4A), the absolute value of reflection coefficient k1[m−2] for subband m−2 will be less than the absolute value of reflection coefficient k1[m] of subband m. Conversely, when the energy of the low frequency tone signal in subband m−1 is greater than the energy of the high frequency tone signal (the case shown in FIG. 4B), the absolute value of reflection coefficient k1[m−2] of subband m−2 is greater than the absolute value of reflection coefficient k1[m] of subband m. This characteristic is referred to below as "characteristic 1".

It is therefore desirable to simultaneously consider the slope of the frequency distribution in both subband m−2 and subband m. Furthermore, using the fact that the absolute value of the reflection coefficient is from 0 to 1, the conditions for detecting aliasing across three subbands preferably first satisfy detection condition 2 above, and also satisfy the following conditions.

When $m$ is even: $k1[m-2]-k1[m]>T$

When $m$ is odd: $k1[m]-k1[m-2]>T$ where T is a predetermined threshold value, such as a value of approximately T=1.0. These are referred to below as "detection condition 3". The detection range of detection condition 3 is narrower than that of detection condition 2. Note that because of the condition $-1<k1[m]<1$ relating to the range of the reflection coefficient, the conditions do not overlap in three consecutive subbands m, m+1, and m+2 when detection condition 2 or detection condition 3 is applied, and thus aliasing will not be detected in three consecutive subbands. Furthermore, aliasing will not be detected in three consecutive subbands even if detection condition 1 is used in conjunction with detection condition 2 or detection condition 3. It will also be obvious that aliasing detection conditions can be set for three consecutive subbands using the reflection coefficients for subbands m−2, m−1, and m.

The subband number where the detection conditions are true is output from the aliasing detector 315 as aliasing detection data 316. The aliasing remover 313 then adjusts the gain for only the subband indicated by detection data 316 to limit aliasing. If, for example, the detection data 316 indicates aliasing occurrence across two subbands according to detection condition 1, gain can be adjusted by matching the gain in subbands m−1 and m, or by limiting the gain difference or gain ratio between the two subbands to a predetermined threshold value or less. When the same gain level is set for both subbands, gain could be set to the lower gain level of the two subbands, to the higher gain level, or to a median level between the high and low gain levels (such as the average).

To prevent detection errors by the aliasing detector 315, the aliasing remover 313 could apply a combination of methods. For example, the aliasing remover 313 could apply gain matching to subbands where aliasing is detected, and apply gain limiting to the other subbands to limit the gain difference or gain ratio to or below a predetermined threshold value.

Furthermore, when the detection data 316 indicates occurrence of aliasing across three subbands based on detection condition 2 or detection condition 3, the aliasing remover 313 could adjust the gain by matching the gain level for all three subbands. Alternatively, a two subband gain matching method as described above could be applied in ascending order from subband m−2, that is, after adjusting the gain for subbands m−2 and m−1, that gain level and the gain for subband m may be matched. This could also be applied in descending order to match the gain between two subbands starting from subband m. Further alternatively, two-subband gain matching in ascending order and descending order as noted above could be applied, and the median of both gain levels could then be determined and applied. When the same gain level is set for two subbands, gain could be set to the lower gain level, to the higher gain level, or to a median level between the high and low gain levels (such as the average).

Further alternatively, the gain difference or gain ratio between the two subbands could be set to a predetermined threshold value or less instead of setting the same gain level for both subbands.

Yet further alternatively, to prevent detection errors by the aliasing detector 315, the aliasing remover 313 could apply a combination of methods. For example, the aliasing remover 313 could apply gain matching to subbands where aliasing is detected, and apply gain limiting to the other subbands to limit the gain difference or gain ratio to or below a predetermined threshold value.

With the above configuration, the gain for only subbands in which aliasing affects sound quality is adjusted, and the gain level indicated in the received bitstream can be used for other subbands. Degraded sound quality due to aliasing can therefore be prevented, and audio degradation due to mismatched gain can also be prevented. For example, when the aliasing remover 313 uses a method as described above for gain matching, gain can be adjusted to the gain level transmitted in a unit of at least two subbands if detection condition 1 is applied by the aliasing detector 315, and can be adjusted to the gain level received in a unit of at least four subbands if aliasing detector 315 uses detection condition 2 or detection condition 3.

It should be noted that the parameter denoting the slope of the frequency distribution of the subband signals could be determined by calculating plural parameters relative to the time base and then smoothing these parameters.

Furthermore, when the linear prediction coefficient or reflection coefficient used as the parameter denoting the slope of the subband signal frequency distribution is used as an intermediate parameter in a conventional band expansion means, all or part of these parameters can be shared, thereby reducing the number of operations required for processing.

EMBODIMENT 3

The aliasing detector 315 in the above second embodiment compares a predetermined threshold value with the reflection coefficients of each subband, and based on the relation between these values detects and outputs as a binary value whether aliasing occurs or not. When the evaluation value changes near the threshold value using a binary value detection method, the aliasing detection value for occurrence/ non-occurrence changes frequently. This complicates tracking whether to adjust or not adjust gain, and can adversely affect sound quality.

The aliasing detector 315 in the present embodiment therefore detects the degree of occurrence of aliasing. That is, rather than using a binary value to simply indicate whether aliasing is detected or not, the occurrence of aliasing is indicated by a continuous value denoting the degree of occurrence of aliasing. Gain is then adjusted based on this continuous value to achieve a smooth transition. Sudden changes in gain caused by changeover of gain adjustment and non-adjustment can be suppressed, and thus the resulting degrading of sound quality can be reduced. It should be noted that the configuration of an audio decoding apparatus according to this third embodiment is the same as that of the second embodiment shown in FIG. 2.

The value denoting the occurrence degree of aliasing is described next.

When detecting aliasing between two subbands, the degree of aliasing d[m] in subband m can be calculated from the following relation.

i) When m is even and k1[m]<q, k1[m−1]<q:

if $k1[m]>k1[m-1]$, $d[m]=(-k1[m]+q)/p$ if $k1[m]\leqq k1[m-1]$, $d[m]=(-k1[m-1]+q)/p$ ii) When m is odd and k1[m]>−q, k1[m−1]>−q:

if $k1[m]>k1[m-1]$, $d[m]=(k1[m-1]+q)/p$ if $k1[m]\leqq k1[m-1]$, $d[m]=(k1[m]+q)/p$ iii) Otherwise:

ti d[m]=0 where p and q are predetermined threshold values, and preferably p=q=approx. 0.25. The upper limit of d[m] is also preferably limited to 1.0.

Gain g[m] and g[m−1] for subband m and subband m−1 are adjusted as follows using degree of aliasing d[m].

When $g[m]>g[m-1]$, $g[m]=(1.0-d[m])\cdot g[m]+d[m]\cdot g[m-1]$

When $g[m]<g[m-1]$, $g[m-1]=(1.0-d[m])\cdot g[m-1]+d[m]\cdot g[m]$

When aliasing detection between three subbands using detection condition 2 or detection condition 3 is combined with aliasing detection between two subbands using detection condition 1, the aliasing occurrence degree d[m] can be calculated using the following method.

First, d[m] is set to 0.0 for all m. Then, d[m] and d[m−1] are determined for m by applying the following method in ascending order.

First, if detection condition 1 is true, then d[m]=1.0. Second, the degree of aliasing d[m] is set as follows only if detection condition 2 or detection condition 3 is true.

i) When m is even:

if d[m]=0.0, $d[m]=(k1[m-2]-k1[m]-T)/s$ if $d[m-1]=0.0$, $d[m-1]=(k1[m-2]-k1[m]-T)/s$ ii) when m is odd:

if d[m]=0.0, $d[m]=(k1[m]-k1[m-2]-T)/s$ if $d[m-1]=0.0$, $d[m-1]=(k1[m]-k1[m-2]-T)/s$ where T and s are predetermined threshold values, and preferably T=0.8 and s=0.4 approximately. The upper limit of d[m] is also preferably limited to 1.0.

The aliasing occurrence degree d[m] can also be calculated using the following method.

First, d[m] is set to 0.0 for all m. Then, d[m] and d[m−1] are determined for m by applying the following method in ascending order.

First, if detection condition 1 is true, then d[m]=1.0. Second, aliasing occurrence degrees d[m] and d[m−1] are set as follows only if detection condition 2 or detection condition 3 is true.

i). When m is even:

if d[m]=0.0, $d[m]=(k1[m-2]-k1[m]-abs(k1[m-1]))$ if $d[m-1]=0.0$, $d[m-1]=(k1[m-2]-k1[m]-abs(k1[m-1]))$ ii) When m is odd:

if d[m]=0.0, $d[m]=(k1[m]-k1[m-2]-abs(k1[m-1]))$ if $d[m-1]=0.0$, $d[m-1]=(k1[m]-k1[m-2]-abs(k1[m-1]))$ Note that abs( ) denotes a function providing an absolute value.

When, for example, gain matching between two subbands in ascending order is applied as described above to adjust the gain between three subbands according to the aliasing occurrence degree d[m], gain g[m] and g[m−1] for subbands m and m−1 can be adjusted as follows.

When g[m]>g[m−1]:

$g[m]=(1.0-d[m])\cdot g[m]+d[m]\cdot g[m-1]$

When g[m]<g[m−1]:

$g[m-1]=(1.0-d[m])\cdot g[m-1]+d[m]\cdot g[m]$

By adjusting gain using the aliasing occurrence degree d[m] determined as described above, audio degradation caused by changeover of gain adjustment process when the gain is adjusted based on a binary value simply indicating whether or not aliasing occurs is detected can be suppressed.

Furthermore, in consideration of characteristic 1 described with reference to FIG. 4A and FIG. 4B, in order to reduce multiple aliasing distortions in successive subbands, the characteristic 1 can be used to calculate the aliasing occurrence degree d[m] to adjust gain.

More specifically, in the case shown in FIG. 4A, the amplitude of the image component in subband m is greater than the amplitude of the image component of subband m−2, and thus the aliasing occurrence degree is greater in subband m than in subband m−2. Conversely, in the case shown in FIG. 4B, the aliasing occurrence degree is greater in subband m−2 than in subband m. It is therefore possible to reduce aliasing distortion according to the degree of the distortion by setting the aliasing occurrence degree d[m] with consideration for this characteristic 1. The aliasing occurrence degree d[m] set according to this characteristic can be obtained from the following equations.

$d[m]=1-k1[m-1]\cdot k1[m-1]$ or $d[m]=1-abs(k1[m-1])$

This method is preferred because the aliasing occurrence degree d[m] goes to 1 (or maximum) when k1[m−1]=0. This is because when the amplitude of low frequency tones and high frequency tones in subband m−1 in FIG. 4A and FIG. 4B is the same, the slope of the frequency distribution for subband m−1 becomes zero, that is, reflection coefficient k1[m−1] goes to 0 the image components in subband m−2 and subband m are the same level, and thus the aliasing occurrence degree must be the same for both.

An example of a method for calculating the aliasing occurrence degree d[m] based on priority determined by characteristic 1 is described next. Note that the method described below uses both aliasing detection over three subbands based on detection condition 2 or detection condition 3, and aliasing detection between two subbands based on detection condition 1.

The aliasing occurrence degree d[m] is first determined from the following equation.

i) When m is even:

if $k1[m]<0$ and $k1[m-1]<0$, d[m]=S, if $k1[m]<0$ and $k1[m-1]<0$ and $k1[m-2]>0$, $d[m-1]=1-k1[m-1]\cdot k1[m-1]$, if $k1[m]<0$ and $k1[m-1]\geqq 0$ and $k1[m-2]>0$, $d[m]=1-k1[m-1]\cdot k1[m-1]$ ii) When m is odd:

if $k1[m]>0$ and $k1[m-1]>0$, d[m]=S, if $k1[m]>0$ and $k1[m-1]>0$ and $k1[m-2]<0$, $d[m-1]=1-k1[m-1]\cdot k1[m-1]$, if $k1[m]>0$ and $k1[m-1]\leqq 0$ and $k1[m-2]<0$, $d[m]=1-k1[m-1]\cdot k1[m-1]$ iii) Otherwise:

d[m]=0 where S is a predetermined value and preferably S=1.0 approximately. Note that value S can be set appropriately using the reflection coefficient in the target subband.

If, for example, gain matching between two subbands in ascending order as described above is applied just like the above described method to adjust the gain between three subbands according to the aliasing occurrence degree d[m], gain g[m] and g[m−1] for subbands m and m−1 can be adjusted as follows.

When g[m]>g[m−1]:

$$g[m]=(1.0-d[m])\cdot g[m]+d[m]\cdot g[m-1]$$

When g[m]<g[m−1]:

$$g[m-1]=(1.0-d[m])\cdot g[m-1]+d[m]\cdot g[m]$$

It should be noted that any characteristic can be used as the value d[m] denoting the aliasing occurrence degree as far as it smoothly changes the maximum amount of gain adjustment when aliasing occurs and the minimum amount of gain adjustment when aliasing does not occur according to the aliasing occurrence degree.

Furthermore, plural values denoting the degree of aliasing occurrence referenced to the time base can be calculated and smoothed for use as degree d[m] of aliasing occurrence.

EMBODIMENT 4

Figure 5:
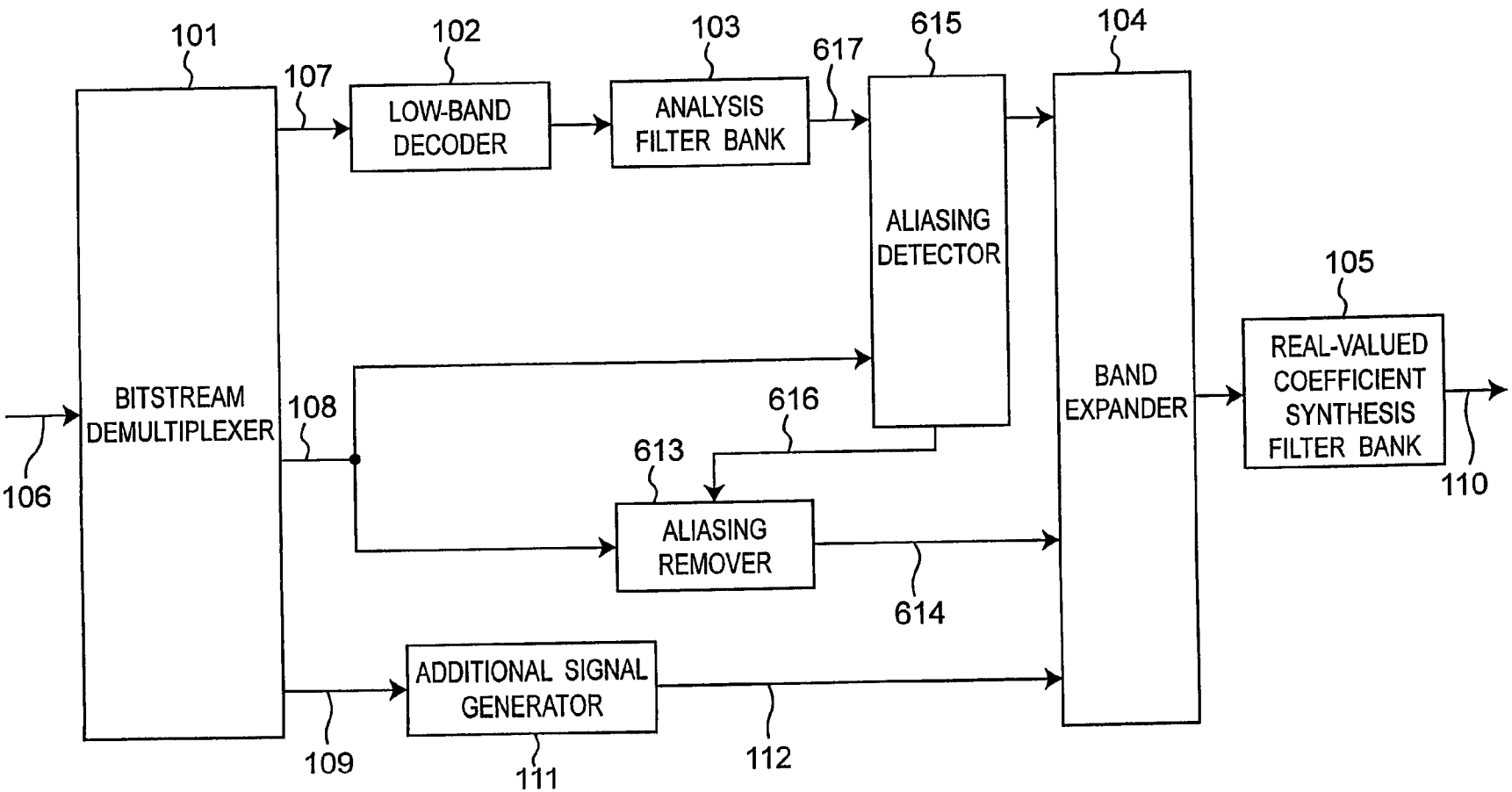
FIG. 5 is a schematic block diagram showing one example of an audio decoding apparatus according to the present invention (a fourth embodiment)

FIG. 5 is a schematic block diagram showing a decoding apparatus according to a fourth embodiment of the present invention. This decoding apparatus differs from the decoding apparatus in the second and third embodiments described above in that high frequency component information 108 from the bitstream demultiplexer 101 is input to the aliasing detector in addition to the low frequency subband signal 617 from the analysis filter bank 103.

This configuration enables the aliasing detector 615 to detect aliasing using both the low frequency subband signal 617 and gain information contained in the high frequency component information 108.

As described above, aliasing becomes a problem when the gain difference between adjacent subbands is large. Furthermore, if the original signal levels near where aliasing occurs is low, only the aliasing component will be audible, thus resulting in a significant degradation in sound quality.

In consideration of the fact, the aliasing detector 615 of this embodiment therefore first references the gain information in the high frequency component information 108 to detect subbands where the gain difference between adjacent subbands is greater than a predetermined level, then references the low frequency subband signal to be copied to the detected subband, and evaluates the level of each low frequency subband. If as a result of this evaluation the level difference between a given subband and adjacent subband is greater than or equal to a predetermined threshold value, that subband is determined to be a subband where aliasing is likely to occur. Subband signal energy, maximum amplitude, total amplitude, average amplitude, or other value could be used to indicate the level of each subband.

The aliasing detector 615 outputs the number of the subbands meeting the above conditions as the aliasing detection data 616. The aliasing remover 613 then adjusts the gain only for the subbands indicated by the aliasing detection data 616 to suppress aliasing.

Gain can be adjusted by setting the same gain level for the adjacent subbands, or by limiting the gain difference or gain ratio between the subbands to a predetermined threshold value or less. When the same gain level is set for both subbands, gain could be set to the lower gain level of the two subbands, to the higher gain level, or to a median level between the high and low gain levels (such as the average).

Furthermore, a combination of methods could be used to prevent detection errors by the aliasing detector 615. For example, gain matching could be applied to subbands where aliasing is detected, and gain limiting could be applied to the other subbands to limit the gain difference or gain ratio to or below a predetermined value.

This configuration thus only adjusts the gain for subbands in which aliasing affecting sound quality is expected, and uses the gain level indicated in the received bitstream for other subbands. Degraded sound quality due to aliasing can therefore be prevented, and audio degradation due to mismatched gain can also be prevented.

EMBODIMENT 5

The audio decoding apparatuses described above in the first to fourth embodiments assume that gain information for high frequency subbands is contained in the high frequency component data, and directly adjust only that gain information. However, gain information can be transmitted by sending the actual gain information, or by sending the energy of the decoded high frequency subband signal. The decoding process in this case gets gain information by determining the ratio between signal energy after decoding and the signal energy of the low frequency subband to be copied to the high frequency subband. This, however, requires calculating the gain of the high frequency subband signal before the process for removing aliasing. This embodiment of the invention therefore describes an audio decoding apparatus enabled with a gain information transmission method that transmits the energy level after high frequency subband decoding.

Figure 6:
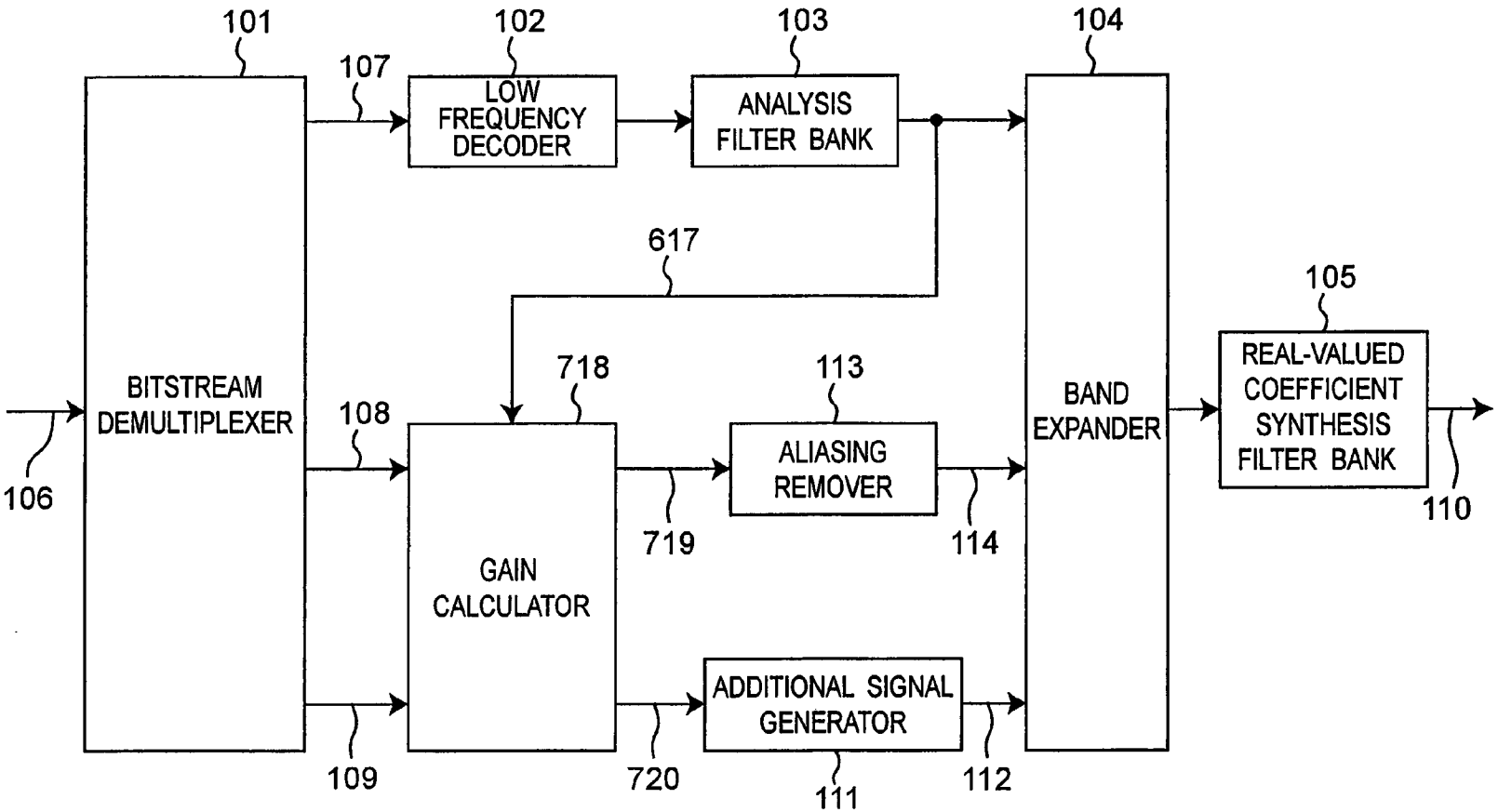
FIG. 6 is a schematic block diagram showing one example of an audio decoding apparatus according to the present invention (a fifth embodiment)
Figure 7:
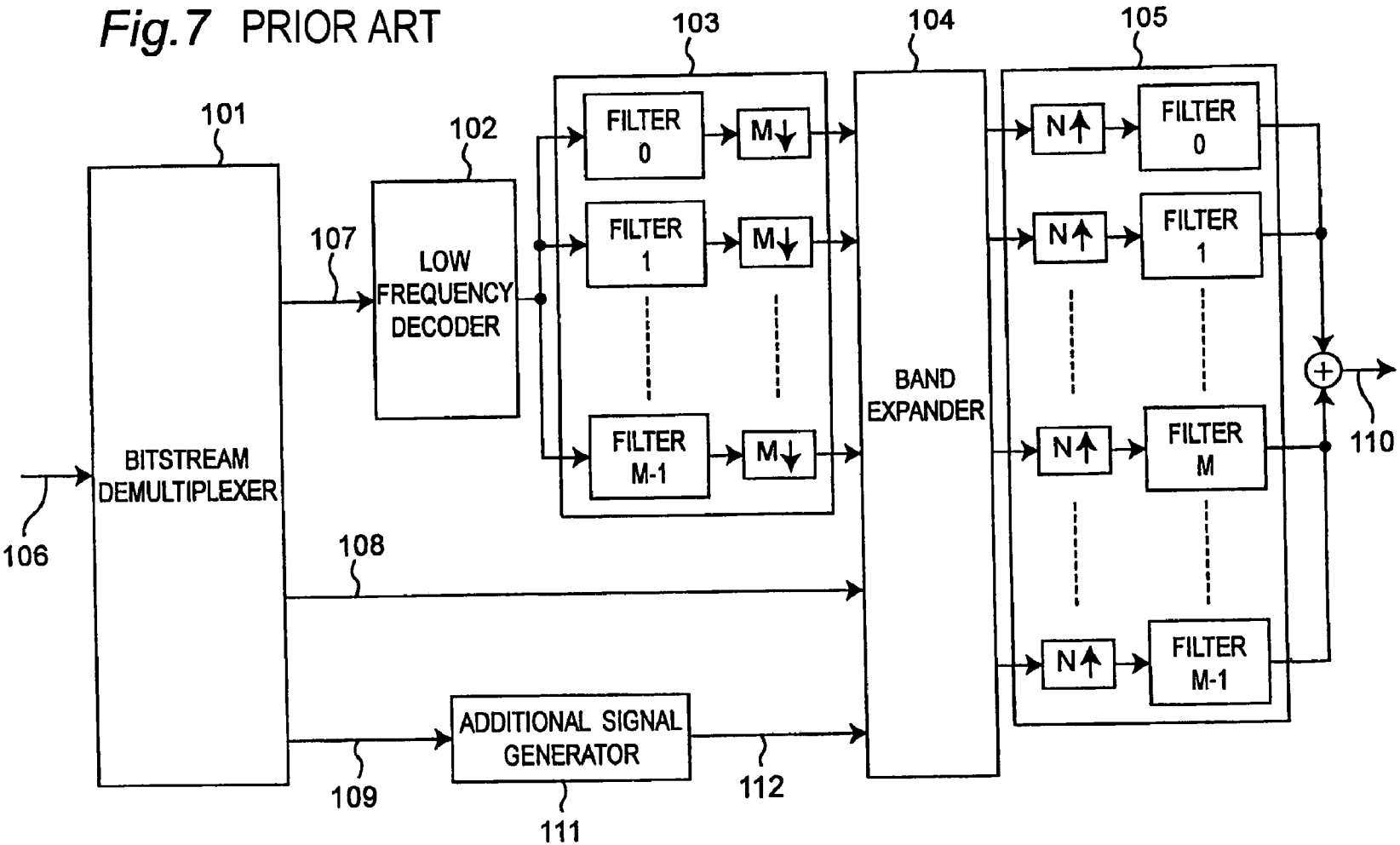
Fig.7 PRIOR ART
FIG. 7 is a schematic block diagram showing an audio decoding apparatus according to the prior art.
Figure 8A:
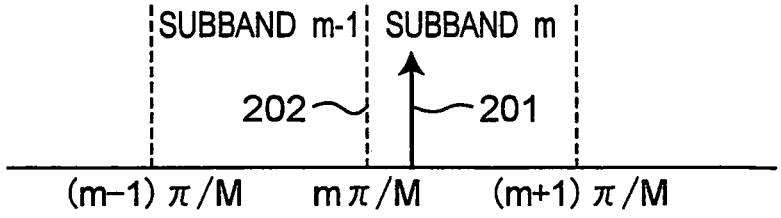
FIG. 8A to FIG. 8E are views for describing how aliasing components are produced.
Figure 8B:
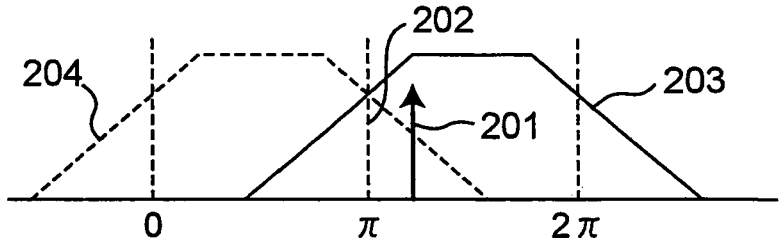
Figure 8C:
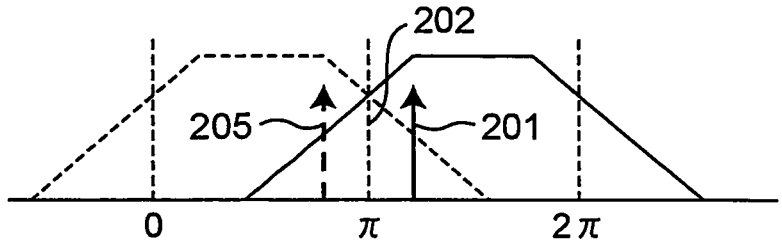
Figure 8D:
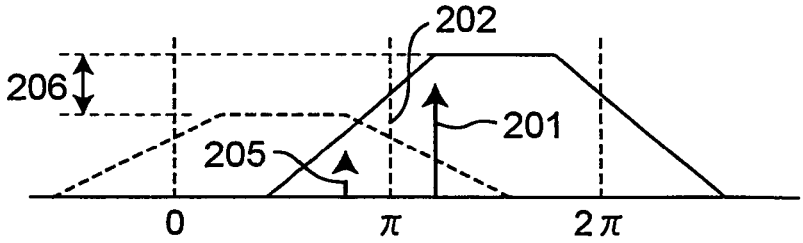
Figure 8E:
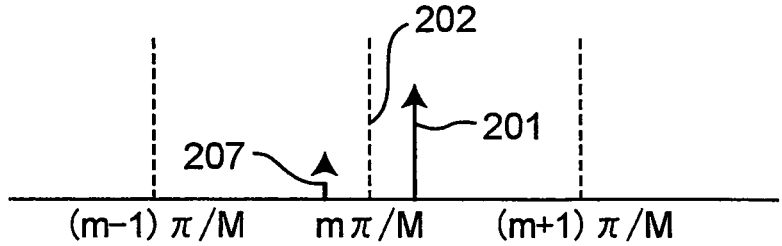

FIG. 6 is a schematic block diagram of an audio decoding apparatus according to this embodiment of the invention. As shown in the figure, this audio decoding apparatus adds a gain calculator 718 for calculating gain for a high frequency subband signal before the process for removing aliasing to the configuration of the decoding apparatus shown in the first embodiment.

The information 108 transmitted for decoding the gain level of the high frequency subband includes two values: the energy R of the high frequency subband after decoding, and the ratio Q between the energy R and the energy added by the additional signal. The gain calculator 718 is identical to a gain calculating part of the band expander 104. This gain calculator 718 calculates gain g for the high frequency subband from these two values, i.e., energy R and ratio Q, and the energy E of the low frequency subband signal 617.

$$g=\mathrm{sqrt}(R/E/(1+Q))$$

where sqrt denotes a square root operator.

The gain information 719 thus calculated for each subband is then sent to the aliasing remover 713 together with the other high frequency information for removing aliasing by the same process described in the first embodiment. It should be noted that this gain information 720 is sent with the additional signal information to the additional signal generator 711. This configuration enables the aliasing remover (removing means) of the present invention also can be applied when high frequency subband energy values are transmitted instead of high frequency subband gain information.

Furthermore, even when high frequency subband energy values are transmitted, the aliasing remover of this embodiment can also be applied to the second to fourth embodiments by calculating the gain of high frequency subband signal before removing aliasing, and inputting the calculated gain of high frequency subband to the aliasing remover 113.

It should be noted that because low frequency subband signal energy can be used in this embodiment of the invention, gain g between two adjacent subbands can be adjusted as follows.

The total energy Et[m] of subbands m−1 and m before gain adjustment is first calculated using the equation $$Et[m]=g[m]^2\cdot E[m]+g[m-1]^2\cdot E[m-1]$$

where g[m−1] and g[m] are the gain of subbands m−1 and m before gain adjustment, and E[m−1] and E[m] are the energy of the corresponding low frequency subband signals, respectively.

Total energy Et[m] is then set as the target energy, and the gain to the reference energy (i.e., low frequency subband signal energy) required to obtain the target energy is calculated. Because this gain is expressed as the square root of the ratio of target energy and reference energy, average gain Gt[m] of subband m−1 and subband m is calculated using the following equation.

$$Gt[m]=\mathrm{sqrt}(Et[m]/(E[m]+E[m-1]))$$

Gain g'[m] of subband m after gain adjustment is then calculated using this average gain Gt[m] and the aliasing occurrence degree d[m] in subband m.

$$g'[m]=d[m]\cdot Gt[m]+(1.0-d[m])\cdot g[m]$$

The energy of subband m changes as a result of this gain adjustment. Gain g'[m−1] of subband m−1 after adjustment can be computed from the following equation to prevent the total energy Et[m] of subband m−1 and subband m from changing because the energy of subband m−1 is equal to Et[m] minus the energy of subband m.

$$g'[m-1]=\mathrm{sqrt}((Et[m]-g'[m]^2\cdot E[m])/E[m-1])$$

If the gain of subband m−1 and subband m is adjusted as described above, the total energy of subbands m−1 and m before gain adjustment and the total energy of subbands m−1 and m after gain adjustment will be the same. In other words, audio degradation caused by a change in signal energy accompanying gain adjustment can be prevented because the gain of each subband can be adjusted without changing the total energy of the two subbands.

Furthermore, the total energy Et[m] of subbands m−1 and m is calculated only from signals copied from the corresponding low frequency subbands, and does not contain energy components which are denoted by energy ratio Q and added by the additional signals. A degradation in sound quality can therefore be prevented because the energy distribution of the subbands signals copied from the low frequency subband can be maintained without being affected by the additional signals.

When this gain adjustment method is applied over three subbands, a value of $g[I]^2\cdot E[I]$ is calculated for each subband I (I=m−2, m−1, m) to be set to the same gain level, and the sum of the three values is then used as Et[m]. As with adjusting gain between two subbands, the average gain Gt[m] is obtained from the following equation, and gain adjustment sets the gain of the target subband to match Gt[m].

$$Gt[m]=\mathrm{sqrt}(Et[m]/(E[m-2]+E[m-1]+E[m]))$$

This method is also used when the number of subbands for which gain is adjusted is 4 or more.

Note, also, that this two subband gain adjustment process can be applied in ascending or descending order as described previously with reference to aliasing remover 113.

Gain can be alternatively adjusted using the aliasing occurrence degree d[m] for two or more subbands as follows. Assuming, for example, that gain is adjusted over three subbands, energy is calculated for each of the subbands m−2, m−1, m for which gain is to be adjusted and the total energy Et[m] is obtained as follows.

$$Et[m]=g[m-2]^2\cdot E[m-2]+g[m-1]^2\cdot E[m-1]+g[m]^2\cdot E[m]$$

The square of the average gain G2t[m] is then calculated from the following equation using this total energy Et[m].

$$G2t[m]=Et[m]/(E[m-2]+E[m-1]+E[m])$$

Using G2t[m], the gain of target subband I (I=m−2, m−1, m) is then provisionally calculated as follows. Note that gain is interpolated using the square in this embodiment.

$$g2[I]=f[I]\cdot G2t[m]+(1.0-f[I])\cdot g[I]^2$$

where f[I] is the greater of d[I] and d[I+1]. The total energy E't[m] using this provisional gain g2[I] is obtained as follows.

$$E't[m]=g2[m-2]\cdot E[m-2]+g2[m-1]\cdot E[m-1]+g2[m]\cdot E[m].$$

Note that total energy E't[m] does not necessarily equal total energy Et[m] described above. Therefore, to prevent the total energy from changing due to gain adjustment, the adjusted gain g'[I] of target subband I (I=m−2, m−1, m) can be set to:

$$g'[I]=\mathrm{sqrt}(b\cdot g2[I])$$

$$b=Et[m]/E't[m].$$

This method can also be used whether the number of gain-adjusted subbands is 2 or 4 or more.

If this gain adjustment method is used, as when gain is adjusted between two subbands, the total energy before gain adjustment and the total energy after gain adjustment will be the same even when gain is adjusted using the aliasing occurrence degree d[m] over more than two subbands. This means that sound quality degradation resulting from a change in signal energy accompanying gain adjustment can be prevented because the gain of each subband can be adjusted without changing the total signal energy. As when gain is adjusted over two subbands as described above, sound quality is also not affected by additional signals.

The audio decoding apparatus configuration described in the above embodiments can also be used when complex-valued low frequency subband signals output from the analysis filter bank 103 are converted to real-valued low frequency subband signals in the band expander 104, and high frequency subband signals are generated by a real number operation. The aliasing detection process can also be applied to converted real-valued low frequency subband signals in the band expander 104. Both cases can be achieved without changing the configuration or processing method of the audio decoding apparatus according to the present invention by converting the processed signal from a complex-valued signal to a real-valued signal, that is, a signal where the imaginary part of the complex-valued signal is 0. This configuration reduces the number of operations performed by the band expander 104 by using real number operations while applying a aliasing removing process to the generated real-valued high frequency subband signals. A degradation in sound quality due to aliasing can therefore be prevented.

Furthermore, the configuration of an audio decoding apparatus described above can also be applied when the analysis filter bank 103 is a real-valued coefficient filter bank. The subband signals resulting from band division by the real-valued coefficient analysis filter bank 103 are real-valued signals, and thus aliasing becomes a problem during high frequency subband signal generation in the same way as when a complex-valued signal is converted to a real-valued signal. Aliasing can be prevented from occurring and therefore the degradation in sound quality caused by the aliasing can be prevented by using the configuration of an audio decoding apparatus described in any of the above embodiments. The number of operations performed can be greatly reduced with this configuration because all decoding operations are done with real number operations.

The process performed by the audio decoding apparatus described in the above embodiments of the invention can also be achieved with a software program coded in a predetermined programming language. This software application can also be recorded to a computer-readable data recording medium for distribution.

Although the present invention has been described in connection with specified embodiments thereof, many other modifications, corrections and applications are apparent to those skilled in the art. Therefore, the present invention is not limited by the disclosure provided herein but limited only to the scope of the appended claims.

It will be further noted that the present invention relates to Japanese Patent Application 2002-300490 filed Oct. 15, 2002, the content of which is incorporated herein by reference.

The invention claimed is:

1. An audio decoding apparatus for decoding a wideband audio signal from a bitstream containing encoded information for a narrowband audio signal, said apparatus comprising:

a bitstream demultiplexer operable to demultiplex the encoded information from the bitstream;

a decoder operable to decode the narrowband audio signal from the demultiplexed encoded information;

an analysis filter bank operable to divide the decoded narrowband audio signal into multiple subband signals composing a first subband signal having a frequency band;

a band expander operable to generate a second subband signal from the first subband signal, the second subband signal being composed of multiple subband signals each having a higher frequency band than the frequency band of the first subband signal;

an aliasing remover operable to adjust a gain based on a degree of aliasing in the subband signals of the second subband signal so as to suppress aliasing components occurring in the subband signals of the second subband signal; and a real-valued calculation synthesis filter bank operable to synthesize the first subband signal and the second subband signal to obtain the wideband audio signal.

2. An audio decoding apparatus for decoding a wideband audio signal from a bitstream containing encoded information for a narrowband audio signal, said apparatus comprising:

a bitstream demultiplexer operable to demultiplex the encoded information from the bitstream;

a decoder operable to decode the narrowband audio signal from the demultiplexed encoded information;

an analysis filter bank operable to divide the decoded narrowband audio signal into multiple subband signals composing a first subband signal having a frequency band;

a band expander operable to generate a second subband signal from the first subband signal, the second subband signal being composed of multiple subband signals each having a higher frequency band than the frequency band of the first subband signal;

an aliasing detector operable to detect a degree of aliasing in the subband signals of the second subband signal generated by the band expander;

an aliasing remover operable to adjust a gain of the subband signals of the second subband signal based on the degree of aliasing detected by the aliasing detector; and a real-valued calculation synthesis filter bank operable to synthesize the first subband signal and the second subband signal to obtain the wideband audio signal.

3. The audio decoding apparatus according to claim 2, wherein aliasing components contain at least components that are suppressed after synthesis by a synthesis filter bank which performs a complex-valued calculation.

4. The audio decoding apparatus according to claim 2, wherein the first subband signal is a low frequency subband signal, and the second subband signal is a high frequency subband signal.

5. The audio decoding apparatus according to claim 4, wherein the aliasing detector uses a parameter denoting a slope of a frequency distribution of the subband signals of the first subband signal to detect the degree of aliasing.

6. The audio decoding apparatus according to claim 5, wherein the aliasing detector evaluates a parameter denoting a slope of a frequency distribution in each of two adjacent subband signals from the subband signals of the first subband signal, and detects the degree of aliasing in the two adjacent subband signals.

7. The audio decoding apparatus according to claim 5, wherein the aliasing detector evaluates a parameter denoting a slope of a frequency distribution in each of three adjacent subband signals from the subband signals of the first subband signal, and detects the degree of aliasing in the three adjacent subband signals.

8. The audio decoding apparatus according to claim 5, wherein the parameter denoting the slope of the frequency distribution is a reflection coefficient.

9. The audio decoding apparatus according to claim 2, wherein:

the bitstream contains additional information used for enabling narrowband to wideband;

the additional information contains high frequency component information describing a feature of a signal in a higher frequency band than the frequency band of the first subband signal;

the bitstream demultiplexer is further operable to demultiplex the additional information from the bitstream; and the band expander is operable to generate the second subband signal composed of the multiple subband signals each having a higher frequency band than the frequency band of the first subband signal, from the first subband signal and the high frequency component information contained in the additional information.

10. The audio decoding apparatus according to claim 9, wherein the high frequency component information contains gain information for a higher frequency band than the frequency band of the first subband signal;

the band expander is operable to generate the second subband signal from the first subband signal based on the gain information; and the aliasing remover is operable to adjust the gain of the subband signals of the second subband signal based on the degree of aliasing detected by the aliasing detector and the gain information in order to suppress aliasing components.

11. The audio decoding apparatus according to claim 9, wherein the high frequency component information contains energy information for signals at a higher frequency band than the frequency band of the first subband signal;

the band expander is operable to generate the second subband signal from the first subband signal based on gain information calculated from the energy information; and the aliasing remover is operable to adjust the gain of the subband signals of the second subband signal based on the degree of aliasing detected by the aliasing detector and the gain information in order to suppress aliasing components.

12. The audio decoding apparatus according to claim 11, wherein the aliasing remover is operable to adjust the gain of the subband signals of the second subband signal so that a total energy of the second subband signal with adjusted gain is equal to a total energy provided by energy information of a corresponding second subband signal.

13. The audio decoding apparatus according to claim 11, wherein the band expander is operable to add an additional signal to the generated second subband signal;

the energy information contains energy R of the second subband signal and ratio Q between the energy R and an energy of the additional signal; and the band expander is operable to calculate energy E of the first subband signal, and calculate gain g of a corresponding second subband signal based on energy R, energy E, and the energy of the additional signal represented by energy ratio Q.

14. The audio decoding apparatus according to claim 13, wherein gain g of the corresponding second subband signal is $$g=\mathrm{sqrt}\{R/E/(1+Q)\}$$

where sqrt is a square root operator.

15. An audio decoding method for decoding a wideband audio signal from a bitstream containing encoded information for a narrowband audio signal, said method comprising:

demultiplexing the encoded information from the bitstream;

decoding the narrowband audio signal from the demultiplexed encoded information;

dividing the decoded narrowband audio signal into multiple subband signals composing a first subband signal having a frequency band;

generating a second subband signal from the first subband signal, the second subband signal being composed of multiple subband signals each having a higher frequency band than the frequency band of the first subband signal;

adjusting a gain based on a degree of aliasing in the subband signals of the second subband signal so as to suppress aliasing components occurring in the subband signals of the second subband signal; and synthesizing the first subband signal and the second subband signal using a real-valued filtering calculation to obtain the wideband audio signal.

16. A program embodied on a computer-readable medium, the program comprising computer executable code operable to cause a computer to perform the audio decoding method according to claim 15.

17. An audio decoding method for decoding a wideband audio signal from a bitstream containing encoded information for a narrowband audio signal, said method comprising:

demultiplexing the encoded information from the bitstream;

decoding the narrowband audio signal from the demultiplexed encoded information;

dividing the decoded narrowband audio signal into multiple subband signals composing a first subband signal having a frequency band;

generating a second subband signal from the first subband signal, the second subband signal being composed of multiple subband signals each having a higher frequency band than the frequency band of the first subband signal;

detecting a degree of aliasing in each of the generated multiple subband signals of the second subband signal before the second subband signal is generated;

adjusting a gain of the subband signals of the second subband signal based on the degrees of aliasing detected; and synthesizing the first subband signal and the second subband signal using a real-valued filtering calculation to obtain the wideband audio signal.

18. The audio decoding method according to claim 17, wherein aliasing components contain at least components that are suppressed after synthesizing with a complex-valued filtering calculation.

19. The audio decoding method according to claim 17, wherein the first subband signal is a low frequency subband signal, and the second subband signal is high frequency subband signal.

20. The audio decoding method according to claim 19, wherein in the detecting the degree of aliasing, a parameter denoting a slope of a frequency distribution of the subband signals of the first subband signal is used to detect the degree of aliasing.

21. The audio decoding method according to claim 20, wherein in the detecting the degree of aliasing, a parameter denoting a slope of a frequency distribution in each of two adjacent subband signals from the subband signals of the first subband signal is evaluated to detect the degree of aliasing in the two adjacent subband signals.

22. The audio decoding method according to claim 20, wherein in the detecting the degree of aliasing, a parameter denoting a slope of a frequency distribution in each of three adjacent subband signals from the subband signals of the first subband signal is evaluated to detect the degree of aliasing in the three adjacent subband signals.

23. The audio decoding method according to claim 20, wherein the parameter denoting the slope of the frequency distribution is a reflection coefficient.

24. The audio decoding method according to claim 17, wherein the bitstream contains additional information used for enabling narrowband to wideband;

the additional information contains high frequency component information describing a feature of a signal in a higher frequency band than the frequency band of the first subband signal; and in the demultiplexing encoded information, the additional information is demultiplexed from the bitstream; and in the generating the second subband signal, the second subband signal composed of the multiple subband signals each having a higher frequency band than the frequency band of the first subband signal is generated from at least one first subband signal and the high frequency component information contained in the additional information.

25. The audio decoding method according to claim 24, wherein the high frequency component information contains gain information for a higher frequency band than the frequency band of the first subband signal;

in the generating the second subband signal, the second subband signal is generated from the first subband signal based on the gain information; and in the adjusting the gain, the gain of the subband signals of the second subband signal is adjusted based on the degree of aliasing detected and the gain information in order to suppress aliasing components.

26. The audio decoding method according to claim 24, wherein the high frequency component information contains energy information for signals at a higher frequency band than the frequency band of the first subband signal;

in the generating the second subband signal, the second subband signal is generated from the first subband signal based on gain information calculated from the energy information; and in the adjusting the gain, the gain of the subband signals of the second subband signal is adjusted based on the degree of aliasing detected and the gain information in order to suppress aliasing components.

27. The audio decoding method according to claim 26, wherein in the adjusting the gain, the gain of the subband signals of the second subband signal is adjusted so that a total energy of the second subband signal with adjusted gain is equal to a total energy provided by energy information of a corresponding second subband signal.

28. The audio decoding method according to claim 26, wherein the generating the second subband signal includes adding an additional signal to the generated second subband signal;

the energy information contains energy R of the second subband signal and ratio Q between the energy R and an energy of the additional signal; and the generating the second subband signal further includes calculating energy E of the first subband signal, and calculating gain g of a corresponding second subband signal based on energy R, energy E, and the energy of the additional signal represented by energy ratio Q.

29. The audio decoding method according to claim 28, wherein gain g of the corresponding second subband signal is $$g=\mathrm{sqrt}\{R/E/(1+Q)\}$$

where sqrt is a square root operator.

30. A program embodied on a computer-readable medium, the program comprising computer executable code operable to cause a computer to perform the audio decoding method according to claim 17.

* * * * *